US009187706B2

(12) United States Patent
Hirano et al.

(10) Patent No.: US 9,187,706 B2
(45) **Date of Patent: *Nov. 17, 2015**

(54) LUBRICATING OIL COMPOSITION

(75) Inventors: Satoshi Hirano, Novato, CA (US); Shigeru Iwamoto, Shizuoka (JP); Morikuni Nakazato, Shizuoka (JP)

(73) Assignee: CHEVRONTEXACO CORPORATION, San Ramon, CA (US)

( * ) Notice: Subject to any disclaimer, the term of this patent is extended or adjusted under 35 U.S.C. 154(b) by 1407 days.

This patent is subject to a terminal disclaimer.

(21) Appl. No.: 10/430,594

(22) Filed: May 6, 2003

(65) Prior Publication Data

US 2003/0216266 A1 Nov. 20, 2003

(30) Foreign Application Priority Data

May 7, 2002 (JP) ..... 2002-131485

(51) Int. Cl.

| | |
|---|---|
| ***C10M 141/10*** | (2006.01) |
| ***C10M 141/12*** | (2006.01) |
| ***C10M 143/10*** | (2006.01) |
| ***C10M 163/00*** | (2006.01) |
| ***C10M 169/04*** | (2006.01) |

(52) U.S. Cl.

CPC ..... *C10M 143/10* (2013.01); *C10M 163/00* (2013.01); *C10M 169/04* (2013.01); *C10M 169/045* (2013.01); *C10M 2203/1006* (2013.01); *C10M 2207/026* (2013.01); *C10M 2207/027* (2013.01); *C10M 2207/028* (2013.01); *C10M 2207/26* (2013.01); *C10M 2207/262* (2013.01); *C10M 2207/289* (2013.01); *C10M 2215/064* (2013.01); *C10M 2215/065* (2013.01); *C10M 2215/28* (2013.01); *C10M 2219/044* (2013.01); *C10M 2219/046* (2013.01); *C10M 2219/086* (2013.01); *C10M 2219/088* (2013.01); *C10M 2219/089* (2013.01); *C10M 2227/09* (2013.01)

(58) Field of Classification Search

USPC ..... 508/375, 376, 371

See application file for complete search history.

(56) References Cited

U.S. PATENT DOCUMENTS

| | | | | |
|---|---|---|---|---|
| 4,529,526 | A | 7/1985 | Inoue et al. | |
| 5,102,566 | A | 4/1992 | Fetterman, Jr. et al. | |
| 5,486,300 | A * | 1/1996 | Salomon et al. | 508/380 |
| 5,672,572 | A * | 9/1997 | Arai et al. | 508/364 |
| 6,551,965 | B2 * | 4/2003 | Nagamatsu et al. | 508/192 |
| 6,569,818 | B2 * | 5/2003 | Nakazato et al. | 508/185 |
| 6,569,819 | B2 * | 5/2003 | Yagishita et al. | 508/291 |
| 6,613,724 | B2 * | 9/2003 | Strickland et al. | 508/460 |
| 6,642,191 | B2 * | 11/2003 | Logan et al. | 508/501 |
| 6,649,575 | B2 * | 11/2003 | Robson | 508/294 |
| 6,720,293 | B2 * | 4/2004 | Bovington et al. | 508/192 |
| 6,730,638 | B2 * | 5/2004 | Farng et al. | 508/194 |
| 6,784,143 | B2 * | 8/2004 | Locke et al. | 508/460 |
| 2001/0044391 | A1 | 11/2001 | Shiga et al. | |

FOREIGN PATENT DOCUMENTS

| | | |
|---|---|---|
| CA | 2349411 | 12/2001 |
| EP | 0475141 | 3/1992 |
| EP | 686689 A2 | 12/1995 |
| EP | 1 167497 | 1/2002 |

* cited by examiner

*Primary Examiner* — Ellen McAvoy

(74) *Attorney, Agent, or Firm* — Jones Day

(57) ABSTRACT

A lubricating oil composition employable in combination with a low sulfur content fuel oil is preferably composed of a base oil having a sulfur content of at most 0.2 wt. %, an ashless dispersant comprising an alkenyl- or alkyl-succinimide or a derivative thereof, a metal-containing detergent containing an organic acid metal salt, a zinc dialkyldithiophosphate, a zinc dialkylaryldithiophosphate, and an oxidation inhibitor selected from the group consisting of a phenol compound, an amine compound, and a molybdenum-containing compound, wherein a ratio of the phosphorus content of the zinc dialkyldithiophosphate to the phosphorus content of the zinc dialkylaryldithiophosphate is in the range of 20:1 to 2:1.

19 Claims, No Drawings

LUBRICATING OIL COMPOSITION

FIELD OF THE INVENTION

This invention relates to a lubricating oil composition favorably employable for lubricating internal combustion engines such as diesel engines, gasoline engines, engines employing dimethyl ether fuel, and gas engines. In particular, the present invention relates to a lubricating oil composition having a low sulfated ash content, a low phosphorus content, and a low sulfur content.

BACKGROUND OF THE INVENTION

Heretofore, diesel internal combustion engines mounted on motor-driven vehicles, construction machines and power generators are generally operated using gas oil or heavy oil (which is a fuel having a sulfur content of approximately 0.05 wt. % or more). Most lubricating oils for diesel engines have a sulfated ash content of approx. 1.3 to 2 wt. %, a sulfur content of approx. 0.3 to 0.7 wt. %, a phosphorus content of approx. 0.1 to 0.13 wt. %.

As for internal combustion engine-mounted vehicles, particularly diesel engine-mounted vehicles, it is required to find ways to obviate environmental pollution problems, such as particulates, caused by the exhaust gas components. For obviating such environmental pollution, exhaust gas-cleaning devices containing a particulate filter and oxidizing catalysts are mounted on the vehicles. The combination of the particulate filter and oxidizing catalysts trap the produced soot and then oxidize and burn the trapped soot. However, metal oxides, sulfates and carboxylates produced by burning of conventional lubricating oils are apt to plug the particulate filter.

Sulfur contained in diesel fuels is also converted to sulfuric acid and sulfates which emigrate into the exhaust gas. The sulfuric acid and sulfates poison, i.e., lower activity of, the oxidizing catalysts in the exhaust gas-cleaning device. Accordingly, it is desirable to decrease the sulfur content of diesel fuel. In the near future, it is expected that new requirements will be issued for further decreasing the sulfur content of diesel fuel to approx. 0.001 wt. % or lower from the present value of approx. 0.05 wt. % to 0.01 wt. % or lower.

As the sulfur content of diesel fuel is decreased, the content of the metal-containing detergent (which functions to neutralize the produced sulfuric acid) in the lubricating oil can be decreased. Lubricating oil is employed for lubricating engine parts, but a portion of the lubricating oil is burnt and emigrates into the exhaust gas. Therefore, the decreased metal-containing detergent content, which means a decrease of the metal content and the sulfur content, is favorable for reducing environmental pollution. Moreover, it is preferred to decrease the phosphorus content in the lubricating oil so as to keep the oxidizing catalysts in the exhaust gas-cleaning system from deterioration. It is also desirable that the content of-chlorine in the lubricating oil is also as low as possible, so as to decrease production of dioxine.

U.S. Pat. No. 5,102,566 describes a low sulfated ash lubricating oil composition which comprises a base oil, at least about 2 wt. % of an ashless nitrogen- or ester-containing dispersant, an oil-soluble antioxidant material, and an oil soluble dihydrocarbyl dithiophosphate anti-wear material, and which has a total sulfated ash (SASH) level of 0.01 to 0.6 wt. % and a weight ratio of SASH to the dispersant in the range of 0.01:1 to 0.2:2.

Japanese Patent Provisional Publication No. 8-48989 describes a lubricating oil composition which has a low sulfated ash content and does not disturb the functions of particulate traps and oxidizing catalysts, but shows good stability at high temperatures so that it can meet the anticipated exhaust gas regulations. The disclosed lubricating oil composition comprises at least 5 wt. % of a boron-containing ashless dispersant, 0.05 to 0.15 wt. % (in terms of phosphorus content) of zinc dithiophosphate, and optionally 0.01 to 2 wt. % of an ashless oxidation inhibitor. The boron content in the composition is at least 0.1 wt. %, the boron content/phosphorus content ratio is at least 0.8, and the sulfated ash content is at most 1.0 wt. %.

European Patent Application No. EP-A-0 686 689 A2 describes an internal combustion engine lubricating oil composition for use with a maintenance-free engine system, which has a total base number of 2.0 to 6.0 mg KOH/g, a low sulfated ash content, and a low phosphorus content. The disclosed lubricating oil composition comprises a specific alkaline earth metal type cleaning agent, zinc dialkyldithiophosphate, a succinic acid imide type ashless dispersant and a phenol type and/or amine type ashless antioxidant.

Japanese Patent Provisional Publication No. 2002-53888 discloses a lubricating oil composition having a sulfur content of 0.01 to 0.3 wt. %, a phosphorus content of 0.01 to 0.1 wt. %, and a sulfated ash in the range of 0.1 to 1 wt. %, which is favorably employable in combination with a fuel oil having a low sulfur content and comprises:

a) a major amount of a mineral base oil having a sulfur content of at most 0.1 wt. %;
b) an ashless dispersant comprising an alkenyl- or alkylsuccinimide or a derivative thereof in an amount of 0.01 to 0.3 wt. % in terms of a nitrogen atom content;
c) a metal-containing detergent containing an organic acid metal salt which is selected from the group consisting of a non-sulfurized alkali metal or alkaline earth metal salt of an alkylsalicylic acid having a TBN of 10 to 350 mg KOH/g and a non-sulfurized alkali metal or alkaline earth metal salt of an alkylphenol derivative having a Mannich base structure, in an amount of 0.1 to 1 wt. % in terms of a sulfated ash content;
d) a zinc dialkyldithiophosphate in an amount of 0.01 to 0.1 wt. % in terms of a phosphorus content; and
e) an oxidation inhibitor such as a phenol compound or an amine compound in an amount of 0.01 to 5 wt. %.

SUMMARY OF THE INVENTION

It is an object of the present invention to provide a lubricating oil composition which has a low sulfur content, a low phosphorus content and a low sulfated ash content, and does not disturb the functions of particulate traps and oxidizing catalysts in exhaust gas-cleaning systems of internal combustion engines. The lubricating oil composition of the present invention shows satisfactory stability at high temperatures so that it can meet future exhaust gas regulations.

It is well known to those skilled in the art that decreasing the sulfur content, phosphorus content, and sulfated ash content in lubricating oil compositions results in lowering of the high temperature stability of a lubricating oil composition.

Accordingly, it has now been discovered that the lowering of the high temperature stability of a lubricating oil composition caused by decreasing the sulfur content, the phosphorus content, and the sulfated ash content can be compensated by using a small amount of a metal-containing detergent having enough soap content, namely, a content of an organic acid metal salt component, in combination with a specific ashless dispersant, zinc dialkyldithiophosphate, zinc dialkylaryldithiophosphate, and a specific oxidation inhibitor.

In this regard, the present invention resides in a lubricating oil composition having a sulfur content of 0.01 to 0.5 wt. %, a phosphorus content of 0.01 to 0.1 wt. %, and a sulfated ash in the range of 0.1 to 1 wt. %, comprising:

a) a major amount of a base oil having a sulfur content of at most 0.2 wt. %;

b) an ashless dispersant comprising an alkenyl- or alkyl-succinimide or a derivative thereof in an amount of 0.01 to 0.3 wt. % in terms of the nitrogen atom content;

c) a metal-containing detergent that contains an organic acid metal salt, having a TBN of 10 to 350 mg KOH/g, and a sulfur content of at most 3.5 wt. %, in an amount of 0.1 to 1 wt. % in terms of the sulfated ash content with the proviso that the organic acid metal salt is incorporated into the lubricating oil composition in an amount of 0.2 to 7 wt. %;

d) a zinc dialkyldithiophosphate in an amount of 0.01 to 0.1 wt. % in terms of the phosphorus content;

e) a zinc dialkylaryldithiophosphate in an amount of 0.002 to 0.05 wt. % in terms of the phosphorus content; and f) an oxidation inhibitor selected from the group consisting of a phenol compound, an amine compound, and a molybdenum-containing compound in an amount of 0.01 to 5 wt. %.

Preferably, the ratio of the phosphorus content of zinc dialkyldithiophosphate to the phosphorus content of zinc dialkylaryldithiophosphate in the lubricating oil composition of the present invention is in the range of 20:1 to 2:1, more preferably 10:1 to 2:1.

The present invention further resides in a lubricating oil composition comprising a base oil having a sulfur content of at most 0.2 wt. %, an ashless dispersant comprising an alkenyl- or alkyl-succinimide or a derivative thereof, a metal-containing detergent containing an organic acid metal salt, a zinc dialkyldithiophosphate, a zinc dialkylaryldithiophosphate, and an oxidation inhibitor selected from the group consisting of a phenol compound, an amine compound, and a molybdenum-containing compound, wherein the ratio of the phosphorus content of zinc dialkyldithiophosphate to the phosphorus content of zinc dialkylaryldithiophosphate is in the range of 20:1 to 2:1.

The present invention further resides in a method of lubricating a diesel engine using a lubricating oil composition of the present invention, the diesel engine being equipped with a particulate filter and/or an exhaust gas-cleaning system and being operated using a diesel fuel having a sulfur content of 0.01 wt. % or less.

The lubricating oil composition of the present invention preferably has a chlorine content of at most 40 ppm, more preferably at most 30 ppm.

Preferably, the ashless dispersant is a succinimide or a derivative thereof which is produced by the steps of subjecting a high reactive polybutene having a methylvinylidene structure and maleic anhydride in a thermal reaction so as to yield a polybutenylsuccinic anhydride and reacting the polybutenylsuccinic anhydride with polyalkylene polyamine.

It is also preferred that a ratio of a nitrogen atom content of the ashless dispersant to the sulfated ash content of the metal-containing detergent is in the range of 1:1 to 1:20, by weight.

It is also preferred that the lubricating oil composition of the present invention has a phosphorus content of not more than 0.08 wt. %, and a sulfur content of not more than 0.35 wt. %.

The oxidation inhibitor employed in the lubricating oil of the present invention preferably comprises at least one of a hindered phenol compound and a diarylamine compound.

The oxidation inhibitor preferably comprises the molybdenum-containing compound in an amount of 30 to 1,000 weight ppm (wt ppm) in terms of the molybdenum content, preferably in addition to the hindered phenol compound and/or the diarylamine compound.

The base oil preferably is a low-aromatic component mineral oil having a viscosity index of at least 120, an evaporation loss of at most 10 wt. %, a sulfur content of at most 0.01 wt. %, and an aromatic component content of at most 10 wt. %, or a mixture of at least 10 wt. % of the low-aromatic component mineral oil and other mineral base oil.

The lubricating oil composition of the present invention preferably satisfies at least one of the requirements for SAE viscosity grades of 0W30, 5W30, 10W30, 0W20 and 5W20.

The metal-containing detergent preferably is a non-sulfurized alkali metal or alkaline earth metal salt of an alkylsalicylic acid having a TBN of 30 to 300 mg KOH/g (more preferably 30 to 100 mg KOH/g). Any metal-containing detergent is employable in the lubricating oil composition of the present invention with the proviso that the organic acid metal salt (i.e., soap) originating from the metal-containing detergent is contained in the lubricating oil composition in an amount of 0.2 to 7 wt. %.

Among other factors, the lubricating oil composition of the present invention shows good detergency at high temperatures, which is accordingly favorably employable in motor-driven vehicles that use fuel of an extremely low sulfur content and are equipped with a particulate filter and an exhaust gas-cleaning system containing oxidizing catalysts. The exhaust gas-cleaning system is mounted on motor-driven vehicles for oxidizing unburnt soot, fuel and lubricating oil. Therefore, the lubricating oil composition of the present invention sufficiently satisfies the recently proposed requirements for exhaust gas. Moreover, the present invention relates to a low environmentally polluting lubricating oil composition which is favorably employable for motor-driven vehicles using hydrocarbon fuels having a low sulfur content such as approx. 0.01 wt. % or less, particularly diesel engine-mounted vehicles to which exhaust gas-cleaning systems containing particulate filters and oxidizing catalysts are attached.

DETAILED DESCRIPTION OF THE INVENTION

In the lubricating oil composition of the present invention, the base oil is a mineral oil or a synthetic oil having a sulfur content of 0.2 wt. % or less, preferably 0.1 wt. % or less, more preferably 0.03 wt. % or less, most preferably 0.005 wt. % or less, and generally having a kinematic viscosity of 2 to 50 $mm^2/s$ at 100° C. The mineral base oil can be produced by processing a lubricating oil grade distillate by solvent refining and/or hydro-treating or hydrocracking.

A mineral base oil having a viscosity index of 120 or more, an aromatic content of less than 10 wt. %, and sulfur-content of less than 0.01 wt. %, which can be obtained by hydrocracking is preferably employed for preparing the lubricating oil composition of the present invention.

The mineral base oil can be an oil produced from natural gas. For example, the mineral base oil can be Shell XHVI (Extra High Viscosity Index) oil.

A portion, preferably less than 50 wt. %, of the mineral base oil can be replaced with a synthetic base oil. Examples of the synthetic base oils include poly-α-olefins (e.g., polymers of α-olefins having 3 to 12 carbon atoms); dialkyl diesters which are di-($C_4$-$C_{18}$)alkyl esters of sebacic acid, azelaic acid, or adipic acid (typically, dioctyl sebacate); polyol esters derived from 1-trimethylolpropane or pentaerythritol and monobasic acids having 3 to 18 carbon atoms; and alkylbenzenes containing an alkyl group of 9 to 40 carbon atoms.

The lubricating oil composition of the present invention contains an ashless dispersant that comprises an alkenyl- or alkyl-succinimide or a derivative thereof in an amount of 0.01 to 0.3 wt. % in terms of the nitrogen atom content. A representative succinimide can be prepared by the reaction of a high molecular weight alkenyl- or alkyl-substituted succinic anhydride and a polyalkylene polyamine having 4 to 10 nitrogen atoms (average value), preferably 5 to 7 nitrogen atoms (average value) per mole. The alkenyl or alkyl group of the alkenyl- or alkyl-succinimide compound is preferably derived from a polybutene having a number average molecular weight of 900 to 5,000.

Conventionally, the reaction between polybutene and maleic anhydride for the preparation of polybutenylsuccinic anhydride is performed by a chlorination process using chlorine. The resulting polybutenylsuccinic anhydride as well as a polybutenylsuccinimide produced from the polybutenylsuccinic anhydride has a chlorine content, for instance, in the range of approx. 2,000 to 3,000 wt. ppm. In contrast, the thermal process using neither chlorine nor chlorine compounds yields a polybutenylsuccinic anhydride and a polybutenyl succinimide having a chlorine content less than 30 wt. ppm. Therefore, a succinimide derived from a succinic anhydride which is produced by the thermal process is preferable since the chlorine content in the lubricating oil composition of the present invention can be 30 wt. ppm or less.

The alkenyl- or alkyl-succinimide can be modified by after-treatment using a boric acid, an alcohol, an aldehyde, a ketone, an alkylphenol, a cyclic carbonate, an organic acid, or the like. Preferable modified succinimides are borated alkenyl- or alkyl-succinimides which are produced by after-treatment using boric acid or a boron-containing compound. Borated alkenyl- or alkyl-succinimides are preferred because of their high thermal and oxidation stability. Alkenyl- or alkyl-succinimides modified with a cyclic carbonate is also preferred.

The lubricating oil composition of the present invention can further contain other ashless dispersants such as succinic acid ester dispersants and benzylamine dispersants.

The lubricating oil composition of the present invention further contains a metal-containing detergent that contains an organic acid metal salt (i.e., soap), having a TBN of 10 to 350 mg KOH/g, and a sulfur content of at most 3.5 wt. %, in an amount of 0.1 to 1 wt. % in terms of the sulfated ash content with the proviso that the organic acid metal salt is incorporated into the lubricating oil composition in an amount of 0.2 to 7 wt. %.

The metal-containing detergent can be an alkaline earth metal sulfonate such as calcium sulfonate or an alkaline earth metal phenate such as calcium phenate, provided that the sulfonate or phenate satisfies the above-mentioned requirements.

The sulfonate detergents can be alkali metal salts or alkaline earth metal salts of petroleum sulfonic acids or alkylbenzenesulfonic acids. Preferred is a sulfonate having a low total base number which has high stability at high temperatures but gives a relatively low sulfated ash content. A phenate detergent may be employed singly or in combination with the sulfonate.

The metal-containing detergent can be a non-sulfurized alkali metal or alkaline earth metal salt of an alkylsalicylic acid having a TBN of 10 to 350 mg KOH/g or a non-sulfurized alkali metal or alkaline earth metal salt of an alkylphenol derivative having a Mannich base structure. Both detergents can be employed in combination. The detergent is used in the lubricating oil composition of the present invention in an amount of 0.1 to 1 wt. % in terms of the sulfated ash content.

The alkylsalicylate is an alkali metal salt or an alkaline earth metal salt of an alkylsalicylic acid which is prepared from an alkylphenol by the Kolbe-Schmitt reaction. The alkylphenol is prepared by a reaction of α-olefin having approx. 8 to 30 carbon atoms (average number) with phenol. The alkaline earth metal salts such as Ca and Mg salts can be produced from Na salt or K salt by double decomposition or decomposition using sulfuric acid. The double decomposition using calcium chloride ($CaCl_2$) is not preferred, because chlorine is incorporated into the resulting salt. Alternatively, calcium salicylate can be produced by direct neutralization of alkylphenol and subsequent carbonation. However, the conversion ratio is less than that of the Kolbe-Schmitt reaction.

Accordingly, a non-sulfurized alkylsalicylate having a TBN of 30 to 300 mg KOH/g, preferably, a TBN of 30 to 100 mg KOH/g, which can be prepared by a series of Kolbe-Schmitt reactions and decomposition using sulfuric acid can be favorably used in the lubricating oil composition of the present invention.

Also employable is an alkali metal salt or an alkaline earth metal salt of an organic acid or phenol derivative having a carbon-nitrogen bond. Generally, a metal-containing detergent having been treated with an amine compound has a base number originating from the basic nitrogen component and hence it advantageously has a low ash but a high base number. For instance, there are exemplified various compounds such as metal salts of aminocarboxylic acids. Most preferred is a non-sulfurized alkylphenate (alkali metal salt or alkaline earth metal salt of alkylphenol derivative) having a Mannich base structure. This compound can be prepared by reacting an alkylphenol, formaldehyde, and an amine or an amine compound in a Mannich reaction. The phenol ring of the resulting compound is amino-methylated; and the obtained product is neutralized with a base such as calcium hydroxide to give the desired metal salt.

The metal-containing detergent is generally available in the form of an oily dispersion which comprises a metal salt of an organic acid (generally referred to as "soap component") and particles of basic inorganic salts (e.g., calcium carbonate particles) gathering around the organic acid metal salt in a base oil. The high temperature detergency, i.e., an ability to keep the inside of engine clean at high temperatures brought about by the lubricating oil composition does not essentially lower when the content of the metal-containing detergent in the lubricating oil composition is decreased, provided that the organic acid metal salt (i.e., soap component) is contained in the oil composition at a certain level, i.e., 0.2 to 7 wt. %.

The lubricating oil composition of the present invention further contains a zinc dialkyldithiophosphate in an amount of 0.01 to 0.1 wt. %, more preferably in an amount of 0.01 to 0.06 wt. %, in terms of the phosphorus content.

The zinc dialkyldithiophosphate preferably is zinc dihydrocarbyldithiophosphate containing an alkyl group of 3 to 18 carbon atoms. A particularly preferred is a zinc dialkyldithiophosphate having an alkyl group derived from a secondary alcohol of 3 to 18 carbon atoms or a mixture of the secondary alcohol and a primary alcohol. The primary alcohol type has a property of high heat resistance.

The lubricating oil composition of the present invention further contains a zinc dialkylaryldithiophosphate in an amount of 0.002 to 0.05 wt. %, preferably 0.002 to 0.03 wt. %, in terms of the phosphorus content. Thus, the zinc dialkylaryldithiophosphate is employed in a small amount in combination with the zinc dialkyldithiophosphate.

The zinc dialkylaryldithiophosphate preferably has two alkylaryl groups in which the alkyl has 3 to 18 carbon atoms. Most preferred is a zinc dialkylaryldithiophosphate derived from dodecylphenol, because the resulting zinc dialkylaryldithiophosphate shows advantageously high heat resistance.

The lubricating oil composition of the present invention further contains an oxidation inhibitor selected from the group consisting of phenol compounds, amine compounds and molybdenum compounds in an amount of 0.01 to 5 wt. %, more preferably 0.1 to 3 wt. %. Generally, a lubricating oil composition having a low sulfated ash content, a low phosphorus content, and a low sulfur content shows low detergency at high temperatures, low oxidation stability and low wear-resistance due to decreases in the amounts of a metal-containing detergent and a zinc dialkylthiophosphate. In order to compensate the decreased detergency, oxidation stability and wear-resistance, a diarylamine oxidation inhibitor and/or a hindered phenol oxidation inhibitor are employed. The diarylamine oxidation inhibitor advantageously gives a base number originating from the nitrogen component, while the hindered phenol oxidation inhibitor advantageously shows inhibition of oil deterioration caused by oxidation in the presence of $NO_x$.

Examples of the hindered phenol compounds include 2,6-di-t-butyl-p-cresol, 4,4'-methylenebis(2,6-di-t-butylphenol), 4,4'-methylenebis(6-t-butyl-o-cresol), 4,4'-thiobis(2-methyl-6-t-butylphenol), 4,4'-isopropylidenebis(2,6-di-t-butylphenol), 4,4'-bis(2,6-di-t-butylphenol), 2,2'-methylenebis(4-methyl-6-t-butylphenol), 4,4'-thiobis(2-methyl-6-t-butylphenol), 2,2-thiodiethylenebis[3-(3,5-di-t-butyl-4-hydroxyphenyl)propionate], octyl 3-(3,5-di-t-butyl-4-hydroxyphenyl)propionate, and octadecyl 3-(3,5-di-t-butyl-4-hydroxyphenyl)propionate.

Examples of the diarylamine compounds include an alkyldiphenylamine containing a mixture of alkyl groups having 4 to 9 carbon atoms, p,p'-dioctyldiphenylamine, phenyl-α-naphthylamine, phenyl-α-naphthylamine, alkylated α-naphthylamine, and alkylated phenyl-α-naphthylamine. Each of the hindered phenol compounds and diarylamine compounds can be employed singly or in combination. Other oil-soluble oxidation inhibitors can be employed in combination.

The lubricating oil composition of the present invention preferably further contains a molybdenum compound and/or a hydrated alkali metal borate in an amount of not more than 5 wt. %, preferably, 0.01 to 5.0 wt. %, for each compound. These compounds give sulfated ash and may have a sulfur content. Accordingly, the amounts of these compounds are controlled in view of the various component contents and the desired characteristics.

The molybdenum compound functions as a friction modifier, an oxidation inhibitor and an anti-wear agent in the lubricating oil composition of the present invention, and further imparts increased high temperature detergency to the lubricating oil composition. The content of the molybdenum compound in the lubricating oil composition of the present invention preferably is in an amount of 10 to 2,500 ppm in terms of the molybdenum element content. Examples of the molybdenum compounds include a sulfur-containing oxymolybdenum succinic imide complex compound, an oxymolybdenum dithiocarbamate sulfide, oxymolybdenum dithiophosphate sulfide, amine-molybdenum complex compound, oxymolybdenum diethylate amide, and oxymolybdenum monoglyceride. Particularly, the sulfur-containing oxymolybdenum succinic imide complex compound is effective for increasing the high temperature detergency.

The addition of a hydrated alkali metal borate is also effective for imparting high temperature detergency and adding a base number to the lubricating oil composition of the present invention. Preparation of typical hydrated alkali metal borates is described in U.S. Pat. No. 3,929,650 and U.S. Pat. No. 4,089,790. For instance, the hydrated alkali metal borate can be prepared by the steps of carbonation of neutral alkali metal or alkaline earth metal sulfonate in the presence of an alkali metal hydroxide to give an over-based sulfonate; and reacting the obtained over-based sulfonate with boric acid so as to produce micro-particles of an alkali metal borate dispersed in the resulting reaction mixture. For the carbonation reaction, an ashless dispersant such as succinimide is preferably present in the reaction mixture. The alkali metal preferably is potassium or sodium. Particularly preferred is a dispersion of micro-particles (particle size: less than approx. 0.3 μm) of $KB_3O_5H_2O$ in a succinimide-containing oil. The corresponding salt in which K is replaced with Na is also advantageously employed from the viewpoint of resistance to hydrolysis.

The lubricating oil composition of the present invention preferably contains a viscosity index improver in an amount of not more than 20 wt. %, preferably 1 to 20 wt. %. Examples of the viscosity index improvers include polyalkyl methacrylate, ethylene-propylene copolymer, styrene-butadiene copolymer, and polyisoprene. The viscosity index improvers can be of a dispersant type or a multi-functional type. The viscosity index improvers can be employed singly or in combination.

The lubricating oil composition of the present invention may contain other auxiliary additives. Examples of other auxiliary additives include zinc dithiocarbamate, methylenebis(dibutyldithiocarbamate), oil soluble copper compounds, sulfur-containing compounds (e.g., olefin sulfide, ester sulfide, and polysulfide), phosphoric acid esters, phosphorous acid esters, and organic amide compounds (e.g., oleylamide) which serve as oxidation inhibitors and anti-wear agents. The examples may further include metal-inactivating agents (e.g., benzotriazole compounds and thiadiazole compounds), anti-rust agents or anti-emulsifiers (e.g., nonionic polyoxyalkylene surfactants such as polyoxyethylene alkylphenyl ether, copolymer of ethylene oxide and propylene oxide), friction modifiers (e.g., amine compounds, amide compounds, amine salts and their derivatives, fatty acid esters of polyhydric alcohols and their derivatives), anti-foaming agents, and pour point depressants. Each of these auxiliary additives can be incorporated into the lubricating oil composition of the present invention in an amount of not more than 3 wt. %, preferably 0.001 to 3 wt. %.

EXAMPLES

The invention will be further illustrated by the following examples, which set forth particularly advantageous method embodiments. While the Examples are provided to illustrate the present invention, they are not intended to limit it. This application is intended to cover those various changes and substitutions that may be made by those skilled in the art without departing from the spirit and scope of the appended claims.

(1) Preparation of Lubricating Oil Composition

Lubricating oil compositions of the present invention and lubricating oil compositions for comparison were prepared employing the below-mentioned components. The lubricating oil compositions were adjusted to give a 5W30 or 10W30 oil (SAE viscosity grade) by the addition of V.I.I. (viscosity index improver).

(2) Additives and Base Oils

Dispersant-A: Borated succinimide-type dispersant (nitrogen content: 1.5 wt. %, boron content: 0.5 wt. %, chlorine content: <5 wt. ppm) prepared by thermal reaction process using polybutene of a number average molecular weight of approx. 1,300, having at least about 50% of methylvinylidene structure and maleic anhydride, by the reaction with polyalkylene polyamine having an average nitrogen atom number of 6.5 (per one molecule), and by the treatment of the resulting succinimide with boric acid, according to Example No. 8 of U.S. Pat. No. 5,356,552.

Dispersant-B: Ethylene carbonate-treated succinimide-type dispersant (nitrogen content: 0.85 wt. %, chlorine content: 30 wt. ppm) prepared by the thermal reaction process using polybutene of a number average molecular weight of approx. 2,300, having at least about 50% of methylvinylidene structure and maleic anhydride, by the reaction with polyalkylene polyamine having an average nitrogen atom number of 6.5 (per one molecule), and by the treatment of the resulting succinimide with ethylene carbonate, according to Example 17 of U.S. Pat. No. 5,356,552.

Detergent-A: Sulfurized calcium phenate (Ca: 9.3 wt. %, S: 3.4 wt. %, TBN: 255 mg KOH/g, available from Chevron-Texaco Japan as OLOA 219).

Detergent-B: Calcium sulfonate (Ca: 12.8 wt. %, S: 2.0 wt. %, TBN: 325 mg KOH/g, available from ChevronTexaco Japan as OLOA 247Z).

Detergent-C: Calcium sulfonate (Ca: 2.4 wt. %, S: 2.9 wt. %, TBN: 17 mg KOH/g, available from ChevronTexaco Japan as OLOA 246S).

Zn-DTP-A: Zinc dialkyldithiophosphate (P: 7.2 wt. %, Zn: 7.85 wt. %, S: 14 wt. %) prepared using secondary alcohol of 3 to 8 carbon atoms.

Zn-DTP-B: Zinc dialkyldithiophosphate (P: 7.3 wt. %, Zn: 8.4 wt. %, S: 14 wt. %) prepared using primary alcohol of 8 carbon atoms.

Zn-DTP-C: Zinc dialkylaryldithiophosphate (P: 2.85 wt. %, Zn: 3.15 wt. %, S: 5.9 wt. %) prepared using dodecylphenol.

Oxidation Inhibitor A: Amine compound [dialkyldiphenylamine, alkyl moiety: mixture of $C_4$ alkyl and $C_8$ alkyl, N: 4.6 wt. %, TBN: 180 mg KOH/g].

Oxidation Inhibitor B: Phenol compound [octyl 3-(3,5-di-t-butyl-4-hydroxyphenyl)-propionate].

Oxidation Inhibitor C: Molybdenum compound (Sulfur-containing oxymolybdenum succinimide complex compound (Mo: 5.4 wt. %, S: 3.7 wt. %, TBN: 45 mg KOH/g).

Oxidation Inhibitor D: Molybdenum compound (Sulfur-containing oxymolybdenum dithiocarbamate (alkyl moiety: mixture of $C_8$ alkyl and $C_{13}$ alkyl, Mo: 4.5 wt. %, S: 4.7 wt. %).

V.I.I.: Viscosity index improver of ethylene-propylene copolymer (non-dispersant type, Paratone® 8057).

P.P.D.: Pour point depressant of polymethacrylate type.

Base oil A: A mixture of 65 weight parts of a hydrocracked oil (kinematic viscosity: 6.5 $mm^2/s$ at 100° C., viscosity index: 132, evaporation loss: 5.6 wt. %, S: <0.001 wt. %, aromatic component content: 9 wt. %) and 35 weight parts of a hydrocracked oil (kinematic viscosity: 4.1 $mm^2/s$ at 100° C., viscosity index: 127, evaporation loss: 15 wt. %, S: <0.001 wt. %, aromatic component content: 8 wt. %).

Base oil B: A mixture of 45 weight parts of a hydrocracked oil (kinematic viscosity: 6.5 $mm^2/s$ at 100° C., viscosity index: 132, evaporation loss: 5.6 wt. %, S: <0.001 wt. %, aromatic component content: 9 wt. %) and 55 weight parts of a solvent-refined oil (kinematic viscosity: 4.4 $mm^2/s$ at 100° C., viscosity index: 101, evaporation loss: 23 wt. %, S: 0.14 wt. %, aromatic component content: 32 wt. %).

(3) Test Procedures a) Measurement of Organic Acid Metal Salt Content (Soap Content)

The mineral oil portion and low molecular weight compounds in the metal-containing detergent were removed by conventional rubber membrane dialysis. The residue (A) remaining in the membrane was weighed. Separately, the content of carbon dioxide originating from carbonate in the metal-containing detergent was measured, and the quantitative analysis of metal elements was carried out. From the carbon dioxide content and the metal content, the amount (B) of over-base components such as calcium carbonate was calculated. The soap content (namely, organic acid metal salt content) was calculated by subtracting (B) from (A).

b) Evaluation of Lubricating Oil Composition for High Temperature Detergency.

The high temperature detergency evaluation test of the lubricating oil composition was conducted according to Diesel Engine Tests JASO M336-98 under the following conditions:

Diesel engine: water-cooled, divided combustion chamber-system, four cylinders, engine swept volume: 2.5 liters.

Operation conditions: operated for 200 hours (lubricating oil was replaced after 100 hours), oil temperature: 120° C., engine speed: 4,300 rpm, full load operation, fuel: diesel fuel oil (gas oil) having a sulfur content of 0.05 wt. %.

Evaluation: after the operation was complete, plugging in the piston top ring groove was measured, and a piston under-crown merit (highest point: 10, according to the method defined by Japan Petroleum Society) was determined.

Example 1

Preparation of a Lubricating Oil Composition of the Present Invention

Formulation:

| | |
|---|---|
| (1) | Ashless dispersant |
| | Dispersant A (amount: 2.1 wt. %, amount in terms of the N content: 0.031 wt. %) |
| | Dispersant B (amount: 7.0 wt. %, amount in terms of the N content: 0.06 wt. %) |
| (2) | Metal-containing detergent |
| | Detergent A (amount: 0.74 wt. %, amount in terms of the sulfated ash content: 0.23 wt. %, amount in terms of the organic metal salt content: 0.3 wt. %) |
| | Detergent B (amount: 0.85 wt. %, amount in terms of the sulfated ash content: 0.07 wt. %, amount in terms of the organic metal salt content: 0.4 wt. %) |
| (3) | Zn-DTP-A (zinc dialkyldithiophosphate) (amount: 0.76 wt. %, amount in terms of the P content: 0.055 wt. %) |
| (4) | Zn-DTP-C (zinc dialkylaryldithiophosphate) (amount: 0.53 wt. %, amount in terms of the P content: 0.015 wt. %) |
| (5) | Oxidation Inhibitor |
| | Oxidation Inhibitor A (amount: 0.3 wt. %) |
| | Oxidation Inhibitor B (amount: 0.2 wt. %) |
| | Oxidation Inhibitor C (amount: 0.2 wt. %) |
| | Oxidation Inhibitor D (amount: 0.1 wt. %) |
| (6) | Other additives |
| | VII (amount: 4.2 wt. %) |
| | PPD (amount: 0.3 wt. %) |
| (7) | Base oil |
| | Base oil A (amount: 82.72 wt. %) |

Comparative Example A

A comparative lubricating oil composition was prepared in accordance with the formulation of Example 1 except that the following zinc compounds and base oil were employed:

Zn-DTP-A (zinc dialkyldithiophosphate)
(amount: 0.83 wt. %, amount in terms of the P content: 0.06 wt. %)
Zn-DTP-B (zinc dialkyldithiophosphate)
(amount: 0.14 wt. %, amount in terms of the P content: 0.01 wt. %)
Base oil A (in an amount of 83.04 wt. %)
The results of these evaluations are set forth in Table 1.

TABLE 1

| Characteristics | Example 1 | Comparative Example A |
|---|---|---|
| SAE viscosity grade | 5W30 | 5W30 |
| Sulfated ash (wt. %) | 0.47 | 0.47 |
| P content (wt. %) | 0.07 | 0.07 |
| S content (wt. %) | 0.23 | 0.23 |
| Cl content (wt. ppm) | <5 | <5 |
| Soap content (wt. %) | 0.7 | 0.7 |
| Dialkyl Zn-DTP/ Dialkylaryl Zn-DTP (P content ratio) | 3.7/1 | — |
| Evaluations: | | |
| (1) Plugging in piston top ring groove (vol. %) | 39.5 | 48.9 |
| (2) Piston under-crown merit (highest: 10) | 8.4 | 8.2 |

Clearly the results set forth in Table 1 show the lubricating oil composition of the present invention (Example 1) containing a certain amount of the soap component and a certain amount of zinc dialkylarylthiophosphate advantageously provides noticeable reduction of deposits in the piston top ring groove and piston under-crown, as compared with the lubricating oil composition of Comparative Example A containing the soap component but no zinc dialkylarylthiohosphate.

Example 2

Preparation of a Lubricating Oil Composition of the Present Invention
Formulation:

(1) Ashless dispersant
Dispersant A (amount: 3.0 wt. %, amount in terms of the N content: 0.045 wt. %)
Dispersant B (amount: 3.9 wt. %, amount in terms of the N content: 0.033 wt. %)
(2) Metal-containing detergent
Detergent A (amount: 1.73 wt. %, amount in terms of the sulfated ash content: 0.54 wt. %, amount in terms of the organic metal salt content: 0.7 wt. %)
Detergent B (amount: 0.44 wt. %, amount in terms of the sulfated ash content: 0.19 wt. %, amount in terms of the organic metal salt content: 0.1 wt. %)
Detergent C (amount: 1.36 wt. %, amount in terms of the sulfated ash content: 0.11 wt. %, amount in terms of the organic metal salt content: 0.6 wt. %)
(3) Zn-DTP-A (zinc dialkyldithiophosphate)
(amount: 0.69 wt. %, amount in terms of the P content: 0.05 wt. %)
(4) Zn-DTP-C (zinc dialkylaryldithiophosphate)
(amount: 0.35 wt. %, amount in terms of the P content: 0.01 wt. %)
(5) Oxidation Inhibitor
Oxidation Inhibitor A (amount: 0.5 wt. %)
Oxidation Inhibitor B (amount: 0.5 wt. %)
Oxidation Inhibitor C (amount: 0.2 wt. %)
(6) Other additives
VII (amount: 5.7 wt. %)
PPD (amount: 0.3 wt. %)
(7) Base oil
Base oil B (amount: 81.33 wt. %)

Comparative Example B

A comparative lubricating oil composition was prepared in accordance with the formulation of Example 2 except that the following zinc compounds and base oil were employed:
Zn-DTP-A (zinc dialkyldithiophosphate)
(amount: 0.69 wt. %, amount in terms of the P content: 0.05 wt. %)
Zn-DTP-B (zinc dialkyldithiophosphate)
(amount: 0.14 wt. %, amount in terms of the P content: 0.01 wt. %)
Base oil B (in an amount of 81.54 wt. %)
The results of these evaluations are set forth in Table 2.

TABLE 2

| Characteristics | Example 2 | Comparative Example B |
|---|---|---|
| SAE viscosity grade | 10W30 | 10W30 |
| Sulfated ash (wt. %) | 0.96 | 0.96 |
| P content (wt. %) | 0.06 | 0.06 |
| S content (wt. %) | 0.31 | 0.31 |
| Cl content (wt. ppm) | <5 | <5 |
| Soap content (wt. %) | 1.4 | 1.4 |
| Dialkyl Zn-DTP/ Dialkylaryl Zn-DTP (P content ratio) | 5/1 | — |
| Evaluations: | | |
| (1) Plugging in piston top ring groove (vol. %) | 26.5 | 44.3 |
| (2) Piston under-crown merit (highest: 10) | 9.0 | 8.8 |

Clearly the results set forth in Table 2 show the lubricating oil composition of the present invention (Example 2) containing a certain amount of the soap component and a certain amount of zinc dialkylarylthiophosphate advantageously provides noticeable reduction of deposits in the piston top ring groove and piston under-crown, as compared with the lubricating oil composition of Comparative Example B containing the soap component but no zinc dialkylarylthiophosphate.

What is claimed is:

1. A motor-driven vehicle lubricating oil composition, comprising:
a) a major amount of a base oil having a sulfur content of at most 0.2 wt. %;
b) an ashless dispersant comprising an alkenyl- or alkylsuccinimide or a derivative thereof in an amount of 0.01 to 0.3 wt. % in terms of the nitrogen atom content;
c) a metal-containing detergent that contains an organic acid metal salt, having a TBN of 10 to 350 mg KOH/g, and a sulfur content of at most 3.5 wt. %, in an amount of 0.1 to 1 wt. % in terms of a sulfated ash content with the proviso that the organic acid metal salt is incorporated into the oil composition in an amount of 0.2 to 7 wt. %;
d) a zinc dialkyldithiophosphate in an amount of 0.01 to 0.06 wt. % in terms of a phosphorus content;
e) a zinc dialkylaryldithiophosphate in an amount of 0.002 to 0.015 wt. % in terms of the phosphorus content; and
f) an oxidation inhibitor selected from the group consisting of a phenol compound, an amine compound, and a molybdenum-containing compound in an amount of 0.01 to 5 wt. %,
wherein:
i) the ratio of the phosphorus content of the zinc dialkyldithiophosphate to the phosphorus content of the zinc dialkylaryldithiophosphate in the motor-driven vehicle lubricating oil composition is in the range of 10:1 to 2:1; and ii) the motor-driven vehicle lubricating oil composition has a sulfur content of 0.01 to 0.5 wt. %, a phosphorus content of 0.01 to 0.1 wt. %, and a sulfated ash in the range of 0.1 to 1 wt. %.

2. The lubricating oil composition of claim 1, wherein the ratio of the phosphorus content of zinc dialkyldithiophosphate to the phosphorus content of zinc dialkylaryldithiophosphate is in the range of 5:1 to 2:1.

3. The lubricating oil composition of claim 1, which has a chlorine content of at most 40 ppm.

4. The lubricating oil composition of claim 1, in which the ashless dispersant has a chlorine content of at most 30 ppm.

5. The lubricating oil composition of claim 1, wherein the ashless dispersant is a succinimide or a derivative thereof which is produced by the steps of subjecting a high reactive polybutene having a methylvinylidene structure and maleic anhydride to thermal reaction to give polybutenylsuccinic anhydride and reacting the polybutenylsuccinic anhydride with polyalkylene polyamine.

6. The lubricating oil composition of claim 1, wherein a ratio of a nitrogen atom content of the ashless dispersant to the sulfated ash content of the metal-containing detergent is in the range of 1:1 to 1:20, by weight.

7. The lubricating oil composition of claim 1, which has a phosphorus content of not more than 0.08 wt. %.

8. The lubricating oil composition of claim 1, which has a sulfur content of not more than 0.35 wt. %.

9. The lubricating oil composition of claim 1, wherein the oxidation inhibitor comprises at least one of a hindered phenol compound and a diarylamine compound.

10. The lubricating oil composition of claim 1, wherein the oxidation inhibitor comprises the molybdenum-containing compound in an amount of 30 to 1,000 wt ppm in terms of the molybdenum content.

11. The lubricating oil composition of claim 9, wherein the oxidation inhibitor further comprises the molybdenum-containing compound in an amount of 30 to 1,000 wt ppm in terms of the molybdenum content.

12. The lubricating oil composition of claim 1, wherein the base oil is a low-aromatic component mineral oil having a viscosity index of at least 120, an evaporation loss of at most 10 wt. %, a sulfur content of at most 0.01 wt. %, and an aromatic component content of at most 10 wt. %, or a mixture of 10 wt. % or more of the low-aromatic component mineral oil and other mineral base oil.

13. The lubricating oil composition of claim 1, which satisfies at least one of the requirements of SAE viscosity grades of 0W30, 5W30, 10W30, 0W20 and 5W20.

14. A method of lubricating a motor-driven vehicle diesel engine with a lubricating oil composition of claim 1, said motor-driven vehicle diesel engine being equipped with a particulate filter and/or an exhaust gas-cleaning system and being operated using a diesel fuel having a sulfur content of 0.01 wt. % or less.

15. A motor-driven vehicle lubricating oil composition comprising a base oil having a sulfur content of at most 0.2 wt. %, an ashless dispersant comprising an alkenyl- or alkylsuccinimide or a derivative thereof, a metal-containing detergent comprising an organic acid metal salt, in an amount of 0.2 to 7 wt. %, a zinc dialkyldithiophosphate, a zinc dialkylaryldithiophosphate, and an oxidation inhibitor selected from a phenol compound, an amine compound or a molybdenum-containing compound, wherein a ratio of the phosphorus content of the zinc dialkyldithiophosphate to the phosphorus content of the zinc dialkylaryldithiophosphate in the motor-driven vehicle lubricating oil composition is in the range of 10:1 to 2:1.

16. The lubricating oil composition of claim 15, which has a phosphorus content in the range of 0.01 to 0.1 wt. %.

17. The lubricating oil composition according to claim 1, where said composition comprises a zinc dialkylaryldithiophosphate in an amount of 0.002 to 0.01 wt. % in terms of the phosphorus content.

18. The lubricating oil composition of claim 15, wherein the ratio of the phosphorus content of zinc dialkyldithiophosphate to the phosphorus content of zinc dialkylaryldithiophosphate is in the range of 5:1 to 2:1.

19. The lubricating oil composition of claim 1, wherein the metal-containing detergent comprises a non-sulfurized alkali metal or alkaline earth meal salt of an alkylsalicylic acid.

* * * * *